United States Patent [19]

Kawasaki et al.

[11] Patent Number: 4,555,427

[45] Date of Patent: Nov. 26, 1985

[54] HEAT TRANSFERABLE SHEET

[75] Inventors: Sadanobu Kawasaki, Tokorozawa; Mineo Yamauchi, Ichikawa; Masanori Akada, Tokyo, all of Japan

[73] Assignee: Dai Nippon Insatsu Kabushiki Kaisha, Tokyo, Japan

[21] Appl. No.: 633,435

[22] Filed: Jul. 23, 1984

[30] Foreign Application Priority Data

Jul. 25, 1983 [JP] Japan ..... 58-135627

[51] Int. Cl.[4] ..... B41M 3/12; D06P 1/41; D06P 5/00

[52] U.S. Cl. ..... 428/195; 8/470; 8/471; 428/913; 428/914

[58] Field of Search ..... 8/470, 471; 428/195, 428/913, 914

[56] References Cited

FOREIGN PATENT DOCUMENTS 0212993 12/1983 Japan ..... 428/913

*Primary Examiner*—Bruce H. Hess

*Attorney, Agent, or Firm*—Parkhurst & Oliff

[57] ABSTRACT

A heat transferable sheet to be heat transfer printed when used in combination with a heat transfer printing sheet has a receptive layer for receiving a dye transferred from the heat transfer printing sheet upon being heated, the receptive layer comprising first and second regions having respective specific properties.

7 Claims, 9 Drawing Figures

HEAT TRANSFERABLE SHEET

BACKGROUND OF THE INVENTION

This invention relates to a heat transferable sheet or a sheet to be heat transfer printed, and more particularly to a heat transferable sheet which is used in combination with a heat transfer printing sheet wherein heat printing is carried out in accordance with image information by means of thermal heads, a laser beam, or the like.

Heretofore, a heat sensitive color-producing paper has been primarily used in order to obtain an image in accordance with image information by means of thermal heads, a laser beam, or the like. In this heat sensitive color-producing paper, a colorless or pale-colored leuco dye (at room temperature) and a developer provided on a base paper are contacted by the application of heat to obtain a developed color image. Phenolic compounds, derivatives of zinc salicylate, rosins and the like are generally used as such a developer.

However, the heat sensitive color-producing paper as described above has a serious drawback in that its color disappears when the resulting developed color image is stored for a long period of time. Further, color printing is restricted to two colors, and thus it is impossible to obtain a color image having a continuous gradation.

On the other hand, a heat sensitive transfer printing sheet wherein a heat-fusing wax layer having a pigment dispersed therein is provided on a base paper has been recently used. When this heat sensitive transfer printing sheet is laminated with a paper to be heat transfer printed, and then heat printing is carried out from the back of the heat sensitive transfer printing sheet, the wax layer containing the pigment is transferred onto the heat transferable paper to obtain an image. According to this printing process, an image having durability can be obtained, and a multi-color image can be obtained by using a heat sensitive transfer printing paper containing three primary color pigments and printing it many times. However, it is impossible to obtain an image having an essentially continuous gradation as in a photograph.

In recent years, there has been a growing demand for a method and means for obtaining an image like a photograph directly from an electrical signal, and a variety of attempts have been made to meet this demand. One of such attempts provides a process wherein an image is projected onto a cathode-ray tube (CRT), and a photograph is taken with a silver salt film. However, when the silver salt film is an instant film, the running cost is high. When the silver salt film is a 35 mm film, the image cannot be instantly obtained because it is necessary to carry out a development treatment after the photographing. An impact ribbon process and an ink jet process have been proposed as further processes. In the former, the quality of the image is inferior. In the latter, it is difficult to simply obtain an image like a photograph because an image treatment is required.

In order to overcome such drawbacks, there has been proposed a process wherein a heat transfer printing sheet provided with a layer of sublimable disperse dyes having heat transferability is used in combination with a heat transferable sheet, and wherein the sublimable disperse dye is transferred onto the heat transferable sheet while it is controlled to obtain an image having a gradation as in a photograph. According to this process, an image having continuous gradation can be obtained from a television signal by a simple treatment. Moreover, the apparatus used in this process is not complicated and therefore is attracting much attention.

One example of prior art technology close to this process is a process for dry transfer calico printing polyester fibers. In this dry transfer calico printing process, dyes such as sublimable disperse dyes are dispersed or dissolved in a solution of synthetic resin to form a coating composition, which is applied onto tissue paper or the like in the form of a pattern and dried to form a heat transfer printing sheet, which is laminated with polyester fibers constituting sheets to be heat transfer printed thereby to form a laminated structure, which is then heated to cause the disperse dye to be transferred onto the polyester fibers, whereby an image is obtained.

However, even if such a heat transfer printing sheet and a polyester fiber, heat transferable sheet are laminated and then subjected to heat printing by means of thermal heads or the like, it is impossible to obtain a developed color image having a high density. While one reason for this is that the surface of the polyester fiber fabric is not sufficiently smooth, it is thought that the main reasons are as follows.

In a conventional dry transfer calico printing process or a wet transfer calico printing process, the transfer of the sublimable dye onto the polyester fiber fabric is carried out with ample heating time. In contrast, heating by means of thermal heads or the like is ordinarily extremely short, whereby the dye is not sufficiently transferred onto the fiber fabric. In the dry transfer calico printing process, the transfer of the dye is accomplished by heating for about one minute at a temperature of 200° C., whereas the heating by means of thermal heads is short, i.e., of the order of several milliseconds at a temperature of 400° C.

We have carried out studies to eliminate the drawbacks described above primarily by improvement of the heat transferable sheet or the sheet to be heat transfer printed. As a result, we have made the following discoveries.

When a clay coated paper or synthetic paper is used as the heat transferable sheet, it cannot sufficiently receive the dye which is transferred from a heat transfer printing sheet, and therefore a developed color image having a high density cannot be obtained.

When a heat transferable sheet which has a receptive layer of synthetic resins having a low melting point is used, the synthetic resin layer per se may acquire a thermal adhesion property by the action of heat and pressure applied to the heat transfer printing sheet, and the heat transfer printing layer of the heat transfer printing sheet may be transferred onto the heat transferable sheet. Consequently, the clearness and definition of the resulting image is impaired.

Furthermore, when a heat transferable sheet which has a receptive layer of synthetic resin having a low glass transition temperature is used, the dye which is heat transfer printed onto the heat transferable sheet is sufficiently fixed, and thus a developed color image having a high density is temporarily obtained. However, it has been found that the dye becomes heat diffused with the elapse of time to distort the image.

On the other hand, when the receptive layer of the heat transferable sheet is formed from a synthetic resin having a high glass transition temperature, the heat diffusion described above can be prevented. However, it has been found that the fixing property of the dye transferred from the heat transfer printing sheet is poor.

In the extreme case, when a soft polyvinyl chloride resin sheet containing plasticizers having an ester group such as dioctyl phthalate is used for the receptive layer of the heat transferable sheet, an excellent developed color image having a high density is once obtained immediately after heat transfer printing. However, the dye dissolves in the plasticizers to become diffused in the sheet. Consequently, when the image is allowed to stand ordinarily for about one week at room temperature, the resulting developed color image becomes extremely unclear, and it is virtually impossible to store the developed color image.

In view of these findings, we have carried out further studies. As a result, we have now found that the problems described above can be solved at one stroke by using a heat transferable sheet which has a specific structure. The present invention has been developed on the basis of this discovery.

SUMMARY OF THE INVENTION

The present invention has been developed to achieve the following objects by using in combination a heat transfer printing sheet having a heat transfer printing layer containing a disperse dye of thermal transferability and a heat transferable sheet which has a specific structure.

(a) One object is to obtain directly a developed color image having a continuous gradation as in photograph from an electrical signal.

(b) Another object is to obtain a highly transparent developed color image having a high density, and to obtain a clear image having a high definition wherein a developed color image will not fade even if it is stored for a long period of time.

(c) A further object is to provide a combination of a heat transfer printing sheet and a heat transferable sheet wherein there is no release transfer of a heat transfer printing layer to a heat transferable layer to be heat transfer printed in heat transfer printing, and wherein the heat transfer printing sheet and the heat transferable sheet do not fuse together.

In order to achieve the above objects of the present invention, a heat transferable sheet which is provided with a receptive layer having the following properties is provided and used in combination with a heat transfer printing sheet.

More specifically, a heat transferable sheet according to the present invention has a receptive layer which receives a dye transferred from a heat transfer printing sheet upon being heated, the receptive layer comprising first and second regions, and has the following properties.

(a) The first region is formed from a synthetic resin having a glass transition temperature of from −100° to 20° C., preferably from −50° to 10° C., and having polar groups such as an ester linkage, urethane linkage, amide linkage, urea linkage, C—CN linkage and C—Cl linkage.

(b) The second region is formed from a synthetic region having a glass transition temperature of at least 40° C., preferably from 50° to 150° C., and preferably the second region-forming synthetic resin has also a polar group.

(c) Both the first region and the second region are exposed at the surface of the receptive layer, and the first region occupies at least 15%, preferably from 15 to 95% of the surface.

(d) The first region is present in the form of mutually independent islands, the respective longitudinal length of which is from 0.5 to 200 μm, preferably from 10 to 100 μm, and desirably the periphery of the first region is substantially surrounded by the second region.

DETAILED DESCRIPTION OF THE INVENTION

Figure 1:
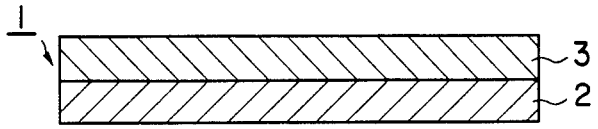
FIGS. 1 and 2 are sectional views of a heat transferable sheet to be heat transfer printed according to the present invention.

Preferred embodiments of the present invention shown in the drawings will now be described.

Figure 2:
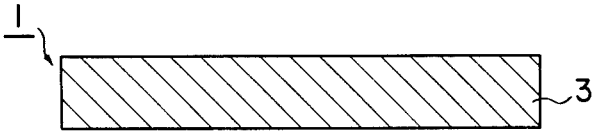

A heat transferable sheet 1 to be heat transfer printed according to the present invention comprises a receptive layer 3 provided on a substrate 2, as shown in FIG. 1. The heat transferable sheet may consist of a single independent receptive layer 3 as shown in FIG. 2. When the receptive layer 3 is provided on the substrate 2, the thickness of the receptive layer 3 is of the order of from 3 to 50 μm, preferably from 5 to 15 μm. On the other hand, when the heat transferable sheet consists of a single receptive layer 3, the thickness of the receptive layer 3 is of the order of from 60 to 200 μm, preferably from 90 μm to 150 μm.

Figure 3:
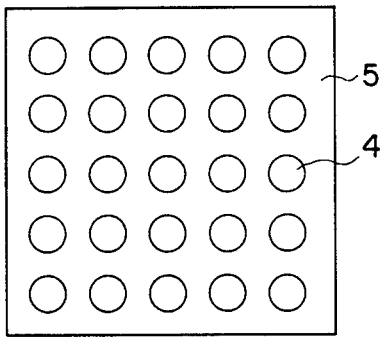
FIG. 3 is an enlarged schematic view of the surface of a receptive layer.

The receptive layer 3 comprises a first region 4 and a second region 5 as shown in FIG. 3. The first region 4 is formed from a synthetic resin having a glass transition temperature of from −100° to 20° C., preferably from −50° to 10° C., and having polar groups such as an ester linkage, urethane linkage, amide linkage, urea linkage, C—CN linkage and C—Cl linkage.

On the other hand, the second region 5 is formed from a synthetic resin having a glass transition temperature of at least 40° C., preferably from 50 to 150° C., and preferably the second region-forming synthetic resin has also a polar group.

The following resins having a glass transition temperature of from −100° to 20° C., preferably from −50° to 10° C., can be used as the synthetic resin capable of forming the first region.

(a) Resins having an ester linkage: polyester resin, polyacrylate resin, polycarbonate resin, polyvinyl acetate resin, styrene-acrylate resin, vinyl toluene-acrylate resin, and the like.

(b) Resins having a urethane linkage: polyurethane resin and the like.

(c) Resins having an amide linkage: polyamide resin and the like.

(d) Resins having a urea linkage: urea resin and the like.

(e) Other resins having a linkage of high polarity: polycaprolactone resin, styrene-maleic anhydride resin, polyvinyl chloride resin, polyacrylonitrile resin, and the like.

In addition to the synthetic resins as enumerated above, mixtures or copolymers thereof, or the like can be used.

When the glass transition temperature of the first region-forming synthetic resin is higher than the range stated above or the synthetic resin has no polar group, it cannot sufficiently receive a dye transferred from a heat transfer printing layer upon being heated, whereby a clear developed color image cannot be obtained.

The following resins having a glass transition temperature of at least 40° C., preferably from 50° to 150° C., are used as the synthetic resin capable of forming the second region.

(a) The above resins having a polar group which are used in forming the first region.

(b) Resins having no polar group and having a glass transition temperature of at least 40° C. such as a styrene resin, styrene copolymer resin, polyvinyl alcohol resin, cellulose resin, rubber resin, polyvinyl butyral resin, ionomer resin and olefin resin.

When the glass transition temperature of the second region-forming synthetic resin is below 40° C., the resulting developed color image fades with the passage of time, and therefore such resins are undesirable.

The first and second regions formed from the resins as described above are both exposed at the surface of the receptive layer, and the first region occupies at least 15%, preferably from 15 to 95%, of the surface of the receptive layer. The first region is present in the form of mutually independent islands, and the respective longitudinal length thereof is from 0.5 to 200 μm, preferably from 10 to 100 μm. Further, it is desirable that the periphery of the first region be substantially surrounded by the second region. It is thought that this is because the first region primarily receives the dye transferred from the heat transfer printing sheet upon being heated, whereas the second region aids in preventing the dye received by the first region from diffusing into other portions.

In order to form the receptive layer having the first and second regions as described above, the following methods can be used.

(i) A first region-forming synthetic resin and a second region-forming synthetic resin are selected from synthetic resins which are mutually inferior in compatibility; these synthetic resins are dissolved in a solvent; the resulting solution is applied onto a substrate or the like; and thereafter the whole is dried to phase separate the above synthetic resins from each other.

(ii) A first region-forming synthetic resin and a second region-forming synthetic resin are amply kneaded, and the blend is applied onto a substrate or the like.

(iii) A second region-forming synthetic resin is provided in the form of a sheet, and a first region-forming synthetic resin coating is printed thereon by means of a printing process such as offset or gravure.

(iv) A second region-forming synthetic resin is provided in the form of a sheet; silicone is applied thereon in the form of a pattern by a printing process as described above; then a first region-forming synthetic resin coating is applied over the entire surface to cause the portions wherein silicone is applied in the form of a pattern to be repelled.

(v) A compound capable of crosslinking by means of electron rays, ultraviolet rays and the like is applied over the entire surface of a substrate, and the whole is irradiated with electron rays or ultraviolet rays to cause crosslinking, for example, in the form of a lattice, to form a first region of un-crosslinked portions and a second region of crosslinked portions.

In forming the receptive layer, when a coating composition in which the first region- and the second region-forming synthetic resins are dissolved or dispersed is used, a variety of additives can be added to the coating composition. These components should be selected from additives which do not prevent the fixing of the dye transferred from the heat transfer printing sheet upon being heated. Such additives for enhancing the releasability from the heat transfer printing sheet include hardened materials of silicone compounds such as hardened materials of epoxy-modified silicone oil and amino-modified silicone oil. Furthermore, an ultraviolet absorber can be used as an additive to prevent the fading of the developed color image due to light.

Figure 4:
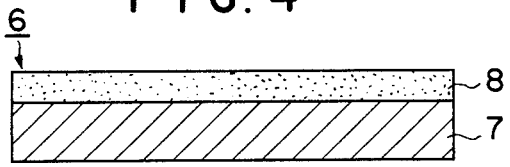
FIG. 4 through FIG. 7 are sectional views of a heat transfer printing sheet used in conjunction with a heat transferable sheet of this invention.

The heat transferable sheet as described above is used in combination with a heat transfer printing sheet. A representative heat transfer printing sheet 6 comprises a heat transfer printing layer 8 provided on one side of a support 7, as shown in FIG. 4. When this heat transfer printing layer 8 is heated, a dye or pigment contained therein is transferred onto the heat transferable sheet.

It is desirable that the support 7 function effectively to hold the heat transfer printing layer 8 and have ample mechanical strength for handling without any trouble even in heat state due to the heat applied in heat transfer printing. Further, in many cases, because heat energy for heat transfer printing is imparted from the side of the support 7 at which no heat transfer printing layer 8 is provided, it is desirable that the support 7 also have the property of readily transmitting heat energy.

Examples of such a support 7 include condenser paper, glassine paper, parchment paper or paper having a high size fastness, and flexible thin sheets such as plastic film. Of these, condenser paper and polyethylene terephthalate film are widely used. If heat resistance is regarded as being important, condenser paper is primarily used. If resistance to rupturing due to mechanical devices during handling is regarded as being important, polyethylene terephthalate film is primarily used. The thickness of this support 7 is ordinarily of the order of from 3 to 50 μm, preferably from 5 to 15 μm.

The heat transfer printing layer 8 contains a colorant capable of emerging from the heat transfer printing sheet upon being heated to be transferred to the receptive layer of the heat transferable layer.

Such colorants include disperse dyes having a relatively small molecular weight of the order of about 150 to 400, oil-soluble dyes, certain basic dyes and intermediates capable of being converted into these dyes. The colorant is selected from among these colorants and used with due consideration of the heat transfer printing temperature, heat transfer printing efficiency, hue, color rendition, weather resistance, and other factors.

The colorant is dispersed in a suitable synthetic resin binder for forming a heat transfer printing layer and is provided on a support 7. It is preferred to select, for this synthetic resin binder, a resin which ordinarily has high heat resistance and does not prevent the transfer of the colorant occurring upon heating. For example, the following binders are used.

(i) Cellulose resins such as ethyl cellulose, hydroxyethyl cellulose, ethylhydroxy cellulose, hydroxypropyl cellulose, methyl cellulose, cellulose acetate, and cellulose acetate butyrate.

(ii) Vinyl resins such as polyvinyl alcohol, polyvinyl acetate, polyvinyl butyral, polyvinyl pyrrolidone, polyester, and polyacrylamide.

Of the synthetic resin binders enumerated above, polyvinyl butyral resins or cellulose resins are preferred for their heat resistance and other desirable properties.

In order to provide the heat transfer printing layer 8 on the support 7, the colorant and the synthetic resin binder may be kneaded with a solvent or diluent to form a coating composition for a heat transfer printing layer. This coating composition may be provided on the support 7 by a suitable printing process or application process. Optional additives may be admixed in the coating composition for the heat transfer printing layer as needed.

Figure 5:
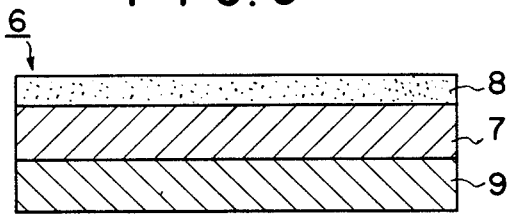

The fundamental structure of the heat transfer printing sheet is as described above. When the surface of the support is directly heated by contact-type heating means such as thermal heads, a lubricating layer 9 containing lubricants or releasing agents such as waxes can be provided on the side of the support 7 having no heat transfer printing layer, as shown in FIG. 5, whereby it is possible to prevent fusing together between the heating means such as thermal heads and the support and to afford smooth sliding.

The heat transfer printing sheet may be in the form of a sheet cut to the specified dimensions, may also be in a continuous or web form, and further may be in the form of a tape of narrow width.

In providing the heat transfer printing sheet 8 on the support 7, a coating composition for the heat transfer printing layer containing one and the same colorant may be applied over the entire surface of the support 7. Optionally, a plurality of coating compositions for the heat transfer printing layer containing different colorants respectively may be respectively applied to different areas of the surface of the support 7.

Figure 6:
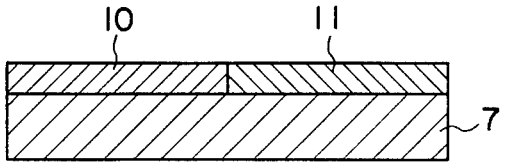
Figure 7:
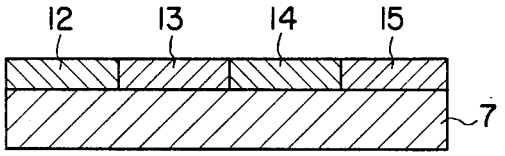

For example, it is possible to use a heat transfer printing sheet as shown in FIG. 6 wherein a black heat transfer printing layer 10 and a red heat transfer printing layer 11 are laminated onto a support 7 in parallel or a heat transfer printing sheet as shown in FIG. 7 wherein a yellow heat transfer printing layer 12, a red heat transfer printing layer 13, a blue heat transfer printing layer 14 and a black heat transfer printing layer 15 are repeatedly provided on a support 7. A multi-color image can be obtained with one heat transfer printing sheet by using a heat transfer sheet provided with such heat transfer printing layers having a plurality of hues.

It is possible to afford convenience during use by forming perforations in the heat transfer printing sheet or by providing register marks or the like for detection of the positions of areas having different hues.

Figure 8:
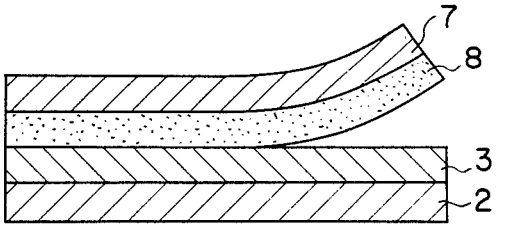
FIG. 8 is a schematic view showing the state wherein a heat transferable sheet and a heat transfer printing sheet are used in combination.

The heat transfer printing sheet and the heat transferable sheet which are prepared as described above are laminated so that the heat transfer printing layer of the heat transfer printing sheet and the receptive layer of the heat transferable sheet are opposed as shown in FIG. 8. The colorant in the heat transfer printing layer is transferred to the receptive layer by imparting heat energy according to the image information to the interface between the heat transfer printing layer and the receptive layer.

In addition to thermal heads, a known heat source such as laser light, infrared flash, or heated pens can be used as the heat source for supplying heat energy. While heat energy may be imparted from the side of the heat transfer printing sheet, from the side of the heat transferable sheet, or from both sides, it is desirable that heat energy be imparted from the side of the heat transfer printing sheet from the standpoint of effective utilization of heat energy.

However, the supply of heat energy from the side of the heat transferable sheet is preferred for the reason that the applied heat energy is controlled to express light and dark gradation of the image or that the diffusion of the colorant on the heat transferable sheet is promoted, thereby further ensuring the expression of continuous gradation of the image. Furthermore, in a process for supplying heat energy from both sides, the advantages of both processes described above can be simultaneously afforded.

When a thermal head is used as a heat source for supplying heat energy, the supplied heat energy can be continuously or stepwisely varied by modulating the voltage or the pulse width applied to the thermal head.

When laser light is used as a heat source for supplying heat energy, the supplied heat energy can be varied by varying the light quantity or irradiation area of the laser light. If a dot generator with a built-in acoustic optical element is used, it is possible to apply heat energy depending upon the size of dot. When laser light is used, the heat transfer printing sheet and the heat transferable sheet may be sufficiently brought into contact to carry out such a process. Also, the face irradiated with laser light may be colored, for example, black for good absorption of the laser light.

When an infrared flash lamp is used as a heat source for supplying heat energy, the application of heat energy may be carried out via a black or like colored layer as with laser light, or it may be carried out via a pattern, expressing continuously the light and shade of black or like image or a dot pattern. Alternatively, it may be carried out by using in combination a black or like colored layer on one face and a negative pattern corresponding to the negative of that pattern.

When heat energy is thus applied to the interface between the heat transfer printing layer and the receptive layer, the colorant in the heat transfer printing layer evaporates or melts in an amount corresponding to the applied heat energy and is heat transferred to the receptive layer and received therein.

While the colorant of a quantity corresponding to the heat energy can be heat transferred to the receptive layer by the heat transfer recording described above to record one color image, a color image comprising a combination of various colors as in a color photograph can also be obtained by using the heat transfer printing sheets in the process described above, for example, by sequentially using yellow, red, indigo and if necessary black heat transfer printing sheets to carry out heat transfer printing according to these colors.

The changing of the heat transfer printing sheets becomes unnecessary when a heat transfer printing sheet having regions which are formed by previously separately painting in each color as shown in FIG. 7 is used in place of the heat transfer printing sheets having respective colors. First a yellow progressive image is heat transfer printed using the yellow region, then a red progressive image is heat transfer printed using the red region of the heat transfer printing sheet, and such steps are repeatedly carried out to heat transfer print yellow, red, indigo and if necessary black progressive images.

The quality of the resulting image can be improved by suitably adjusting the size of the heat source which is used to provide heat energy, the contact state of the heat transfer printing sheet and the heat transferable sheet, and the heat energy.

By using in combination with the heat transfer printing sheet, the heat transferable sheet according to the present invention can be utilized in the print preparation of a photograph, by printing, facsimile or magnetic recording systems wherein various printers of thermal printing systems are used, or in print preparation from a television picture.

For example, a received television picture can be regenerated as a print of sheet form by storing the picture as signals of respective progressive patterns in yellow, red, indigo and if necessary black in a storage medium such as a magnetic tape or a magnetic disc, outputting the stored signals of the progressive patterns, and imparting heat energy corresponding to these signals to the laminate of the heat transfer printing sheet and the heat transferable sheet by means of a heat source such as thermal heads to sequentially carry out heat transfer printing in all colors.

When the laminate of the heat transfer printing sheet and the heat transferable sheet according to the present invention is used for printout of such a television picture, the use of a white receptive layer alone, a colorless transparent receptive layer backed with a substrate such as paper, or a white receptive layer backed with a substrate such as paper as the heat transferable sheet is ordinarily convenient for obtaining a reflection image.

Furthermore, when the combination of letters, patterns, symbols, colors, and the like formed on a CRT picture by the operation of a computer, or a graphic pattern is utilized as an original, steps similar to those described above can be carried out. When the original is a fixed image such as a picture, photograph or printed matter, or an actual object such as persons, still life, or a landscape, the steps can be carried out via suitable means such as a video camera in the same manner as described above. Further, in producing the signal of each progressive pattern from an original, an electronic color scanner which is used for a photomechanical process of printing may be used.

While the present invention is described more fully hereinbelow with respect to Examples, the present invention is not limited to these Examples. Throughout these Examples quantities expressed in "parts" are by weight.

EXAMPLE 1

A PET film (manufactured by Toyobo, Japan under the name S PET) having a thickness of 9 μm wherein one surface had been subjected to a corona treatment was used as a support. A coating composition for a heat transfer printing layer having the following composition was applied and formed on the corona treated surface of the film by a wire bar coating process to a dry thickness of 1 μm. One or two drops of silicon oil (manufactured by Sin-etsu Silicone, Japan under the name X-41-4003A) was dropped on the reverse side by means of a dropping pipet and thereafter spread over the entire surface to carry out a reverse side treatment coating to prepare a heat transfer printing sheet.

Coating Composition for Heat Transfer Printing Layer

| | |
|---|---|
| Disperse dye (manufactured by Nippon Kayaku, Japan under the name Kayaset Blue 136) | 4 parts |
| Ethylhydroxyethyl cellulose (manufactured by Hercules Incorporated) | 5 parts |
| Toluene | 40 parts |
| Methyl ethyl ketone | 40 parts |
| Dioxane | 10 parts |

A synthetic paper having a thickness of 150 μm (manufactured by Ohji Yuka, Japan under the name YUPO-FPG-150) was used as a substrate. A coating composition for a receptive layer having the following composition was applied to this surface by a wire bar coating process to a dry thickness of 10 μm thereby to prepare a heat transferable sheet. Drying was carried out for one hour in an oven at 100° C. after pre-drying in a dryer. (The solvent was thoroughly driven off.)

Coating Composition for Receptive Layer

| | |
|---|---|
| Byron 103 (polyester resin manufactured by Toyobo, Japan; Tg = 47° C.) | 8 parts |
| Elbaroi 741 (EVA polymer plasticizer manufactured by Mitsui Polychemical, Japan; Tg = −32° C.) | 2 parts |
| KF-393 (amino-modified silicone oil manufactured by Sin-etsu Silicone, Japan) | 0.125 part |
| X-22-343 (epoxy-modified silicone oil manufactured by Sin-etsu Silicone, Japan) | 0.125 part |
| Toluene | 70 parts |
| Methyl ethyl ketone | 10 parts |
| Cyclohexanone | 20 parts |

Byron 103 is a second region-forming synthetic resin and Elbaroi 741 is a first region-forming synthetic resin. Because the mutual compatibility of these resins is poor, when they are dissolved in a solvent and the solution is then applied onto a substrate and dried, phase separation occurs to form a first region and a second region.

In the surface of the receptive layer obtained as described above, the periphery of Elbaroi 741 resin which formed the first region was substantially surrounded by Byron 103 resin which formed the second region. The size of the first region formed by surrounding with the second region was in the range of from 5 μm to 100 μm. The proportion of the integrated surface area of the first region portions was 30% of the total.

The heat transfer printing sheet and the heat transferable sheet which were obtained as described above were laminated with the heat transfer printing layer and receptive layer in mutual contact. Recording was carried out from the support side of the heat transfer printing sheet by means of a thermal head under the conditions of an output of lw/dot, a pulse width of from 0.3 to 4.5 milliseconds and a dot density of 3 dots/mm, of the thermal head. When the optical reflection density of highly developed color density recording portions was measured by means of a Macbeth RD918 reflection densitometer, a value of 2.0 was obtained. The tone obtained at this time had the same transparency as that obtained by causing each dye to undergo monomolecular dispersion and forming colors.

When a thermal diffusion acceleration test was carried out by allowing the recorded sheet described above to stand for 7 days in a 60° C. oven, distortion of the image due to dye diffusion was not observed, and reduction of the density of the recording portions did not occur.

Figure 9:
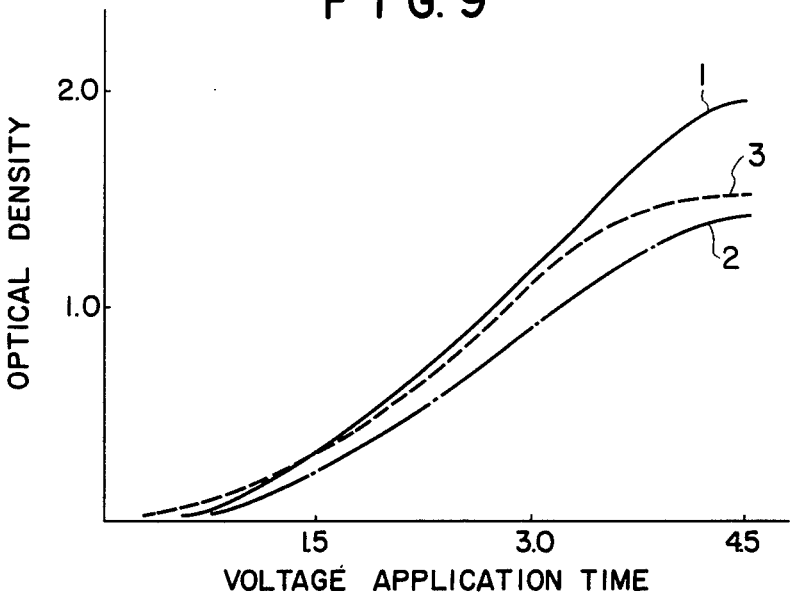
FIG. 9 is a graph indicating relationships between time during which voltage is applied to a thermal head in heating the combination of a heat transfer printing sheet and a heat transferable sheet according to the present invention and the optical reflection density of the resulting highly developed color density recording portions.

Also, the heat transferable sheet and the heat transfer printing sheet which were obtained as described above were used in combination to examine the relationship between voltage application time to a thermal head and the optical reflection density of the resulting highly developed color density recording portions. The results obtained are shown in curve 1 of FIG. 9.

COMPARATIVE EXAMPLE 1

A receptive layer-forming coating composition having the following composition was applied and formed on the same substrate described in Example 1 by a wire bar coating process to a dry thickness of 10 μm to form a heat transferable sheet.

Receptive Layer-forming Coating Composition

| | |
|---|---|
| Elbaroi 741 (manufactured by Mitsui Polychemical, Japan) | 10 parts |
| KF-393 (manufactured by Sin-etsu Silicone, Japan) | 0.125 part |
| X-22-343 (manufactured by Sin-etsu Silicone, Japan) | 0.125 part |
| Toluene | 50 parts |
| Methyl ethyl ketone | 50 parts |

When the heat transferable sheet obtained as described above and the same heat transfer printing sheet as described in Example 1 were used to carry out recording in the manner described in Example 1, the optical reflection density of the highly developed color density recording portions of the resulting recorded sheet was a value of 2.1 and exhibited a higher value than that of the density obtained in Example 1.

However, when a thermal diffusion acceleration test was carried out by allowing the recorded sheet described above to stand for 7 days in a 60° C. oven, the image was significantly distorted due to dye diffusion, and a reduction of the density of the total recording portions was observed. The optical reflection density of the highly developed color density recording portions was reduced to 1.8.

COMPARATIVE EXAMPLE 2

A receptive layer-forming coating composition having the following composition was applied and formed on the same substrate described in Example 1 by a wire bar coating process to a dry thickness of 10 μm to form a heat transferable sheet.

Receptive Layer-forming Coating Composition

| | |
|---|---|
| Byron 103 (polyester resin manufactured by Toyobo, Japan) | 10 parts |
| KF-393 (manufactured by Sin-etsu Silicone, Japan) | 0.125 part |
| X-22-343 (manufactured by Sin-etsu Silicone, Japan) | 0.125 part |
| Toluene | 50 parts |
| Methyl ethyl ketone | 50 parts |

When the heat transferable sheet obtained as described above and the heat transfer printing sheet of Example 1 were used to carry out recording in the manner described in Example 1, the optical reflection density of the highly developed color density recording portions of the resulting recorded sheet was a value of 1.4.

This value was lower than that of Example 1. Further, the resulting tone was inferior in transparency to that of Example 1, and the developed color was inadequate.

When the recorded sheet described above was allowed to stand for 7 days in a 60° C. oven to carry out a thermal diffusion acceleration test, distortion of the image due to dye diffusion was not observed. However, the developed color density was as high as 1.7, and the tone had changed to the same transparency as that obtained by causing each dye to undergo monomolecular dispersion and forming color.

EXAMPLE 2

A receptive layer-forming coating composition having the following composition was applied and formed on the same substrate as described in Example 1 by a wire bar coating process to a dry thickness of 10 μm to form a heat transferable sheet.

Receptive Layer-forming Coating Composition

| | |
|---|---|
| Byron 103 (manufactured by Toyobo, Japan; Tg = 47° C.) | 7 parts |
| Barsalon 1138 (polyamide resin manufactured by Henkel Nippon, Japan; Tg = −4° C.) | 3 parts |
| KF 393 (manufactured by Sin-etsu Silicone, Japan) | 0.125 part |
| X-22-343 (manufactured by Sin-etsu Silicone, Japan) | 0.125 part |
| Toluene | 57 parts |
| Xylene | 13 parts |
| Methyl ethyl ketone | 6.3 parts |
| 2-Butanol | 14 parts |
| Cyclohexanone | 30 parts |

Byron 103 is a second region-forming synthetic resin and Barsalon 1138 is a first region-forming synthetic resin. Because the mutual compatibility of these resins is poor, when they are dissolved in a solvent and the solution is then applied onto a substrate and dried, phase separation occurs to form a first region and a second region.

In the surface of the receptive layer obtained as described above, the periphery of Barsalon 1138 resin which formed the first region was substantially surrounded by Byron 103 resin which formed the second region. The size of the first region formed by surrounding with the second region was in the range of from 1 μm to 100 μm. The proportion of the integrated surface area of the first region portions was 30% of the total. When the heat transferable sheet obtained as described above and the same heat transfer printing sheet as described in Example 1 were used to carry out recording in the manner described in Example 1, the optical reflection density of the highly developed color density recording portions of the resulting recorded sheet exhibited a value of 1.79.

When a thermal diffusion acceleration test was carried out by allowing the recorded sheet described above to stand for 7 days in a 60° C. oven, distortion of the image due to dye diffusion was not observed, and reduction of the density of the recording portions did not occur.

EXAMPLE 3

A receptive layer-forming coating composition having the following composition was applied and formed on the same substrate as described in Example 1 by a wire bar coating process to a dry thickness of 10 μm to form a heat transferable sheet.

Receptive Layer-forming Coating Composition

| | |
|---|---|
| Pandex T5670 (polyurethane elastomer manufactured by Dai Nippon Ink Kagaku, Japan; Tg = −35° C.) | 3 parts |
| Eslex BX-1 (polyvinyl butyral resin manufactured by Sekisui Kagaku, Japan; Tg = +83° C.) | 7 parts |
| KF-393 (manufactured by Sin-etsu Silicone, Japan) | 0.125 part |
| X-22-343 (manufactured by Sin-etsu Silicone, Japan) | 0.125 part |
| Toluene | 70 parts |
| Methyl ethyl ketone | 70 parts |
| Methyl isobutyl ketone | 12 parts |
| Ethyl cellosolve | 5 parts |

Pandex T5670 is a first region-forming synthetic resin and Eslex BX-1 is a second region-forming synthetic resin. Because the mutual compatibility of these resins is poor, when they are dissolved in a solvent and the solution is then applied onto a substrate and dried, phase separation occurs to form a first region and a second region.

In the surface of the receptive layer obtained as described above, the periphery Pandex T5670 resin which formed the first region was substantially surrounded by Eslex BX-1 resin which formed the second region. The size of the first region formed by surrounding with the second region was in a range of no more than 20 μm. The proportion of the integrated surface area of the first region portions was 15% of the total.

When the heat transferable sheet obtained as described above and the same heat transfer printing sheet as described in Example 1 were used to carry out recording in the manner described in Example 1, the optical reflection density of the highly developed color density recording portions of the resulting recorded sheet exhibited a value of 1.3.

When the recorded sheet described above was allowed to stand for 7 days in a 60° C. oven to carry out a thermal diffusion acceleration test, distortion of the image due to dye diffusion was not observed, and reduction of the density of the recording portions did not occur.

EXAMPLE 4

A receptive layer-forming coating composition having the following composition was applied and formed on the same substrate as described in Example 1 by a wire bar coating process to a dry thickness of 10 μm to form a heat transferable sheet.

Receptive Layer-forming Coating Composition

| | |
|---|---|
| Byron 630 (polyester resin manufactured by Toyobo, Japan; Tg = 7° C.) | 2 parts |
| Eslex BX-1 (polyvinyl butyral resin manufactured by Sekisui Kagaku, Japan; Tg = 83° C.) | 4 parts |
| KF-393 (manufactured by Sin-etsu Silicone, Japan) | 0.075 part |
| X-22-343 (manufactured by Sin-etsu Silicone, Japan) | 0.075 part |
| Toluene | 46 parts |
| Methyl ethyl ketone | 42 parts |
| Cyclohexanone | 4 parts |

Byron 630 is a first region-forming synthetic resin and Eslex BX-1 is a second region-forming synthetic resin. Because the mutual compatibility of these resins is poor, when they are dissolved in a solvent and the solution is applied onto a substrate and dried, phase separation occurs to form a first region and a second region.

In the surface of the receptive layer obtained as described above, the periphery of Byron 630 resin which formed the first region was substantially surrounded by Eslex BX-1 resin which formed the second region. The size of the first region formed by surrounding with the second region was in a range of from 1 μm to 100 μm. The proportion of the integrated surface area of the first region portions was 30% of the total.

When the heat transferable sheet obtained as described above and the same heat transfer printing sheet as described in Example 1 were used to carry out recording in the manner described in Example 1, the optical reflection density of the highly deveveloped color density recording portions of the resulting recorded sheet was found to be a value of 1.2.

When the recorded sheet described above was allowed to stand for 7 days in a 60° C. oven to carry out a thermal diffusion acceleration test, distortion of the image due to dye diffusion was not observed, and reduction of the density of the recording portions did not occur.

EXAMPLE 5

A receptive layer-forming coating composition having the following composition was applied and formed on the same substrate as described in Example 1 by a wire bar coating process to a dry thickness of 15 μm to form a heat transferable sheet.

Receptive Layer-forming Coating Composition

| | |
|---|---|
| Byron 103 (polyester manufactured by Toyobo, Japan; Tg = 47° C.) | 8 parts |
| Elbaroi 741 (manufactured by Mitsui Polychemical, Japan; Tg = −32° C.) | 2 parts |
| KF-393 (manufactured by Sin-etsu Silicone, Japan) | 0.125 part |
| X-22-343 (manufactured by Sin-etsu Silicone, Japan) | 0.125 part |
| Cinubin 328 (ultraviolet absorber manufactured by Ciba-Geigy Corporation) | 0.5 part |
| Toluene | 70 parts |
| Methyl ethyl ketone | 10 parts |
| Cyclohexanone | 20 parts |

Byron 103 is a second region-forming synthetic resin and Elbaroi 741 is a first region-forming synthetic resin. Because the mutual compatibility of these resins is poor, when they are dissolved in a solvent, and the solution is applied onto a substrate and dried, phase separation occurs to form a first region and a second region.

The heat transferable sheet obtained as described above and the same heat transfer printing sheet as described in Example 1 were used to carry out recording in the manner described in Example 1. The hue and the optical density of the recording portions obtained were the same as those obtained in Example 1.

Furthermore, when a thermal diffusion acceleration test was carried out by allowing the recorded sheet to stand for 7 days in a 60° C. oven, the same results as described in Example 1 were obtained.

The recorded sheet described above was irradiated with light by means of a due cycle superlong life sunshine weather-meter (manufactured by Suga Shikenki, Japan) to carry out a light-resistance test. When the recorded sheet obtained by Example 1 was irradiated with light for 2 hours, it discolored to a reddish hue. Even when the recorded sheet according to this Example 5 was irradiated with light for 2 hours, no discoloration was observed because the ultraviolet absorber was incorporated in the receptive layer.

EXAMPLE 6

The following components were dispersed in water and continuously stirred for 60 minutes at a temperature of 50° C. They were subjected to ultrasonic dispersion for 5 minutes to prepare a receptive layer-forming coating composition.

Receptive Layer-forming Coating Composition

| | |
|---|---|
| Gosenol T330 (polyvinyl alcohol manufactured by Nippon Gosei, Japan; Tg = 68° C.) | 4 parts |
| Polysol EVA AD-5 (ethylene-vinyl acetate emulsion manufactured by Showa Kohbunshi, Japan; Tg = 0° C.) | 10 parts |
| Water | 76 parts |

Gosenol T330 is a second region-forming synthetic resin and Polysol EVA AD-5 is a first region-forming synthetic resin.

The receptive layer-forming coating composition was applied and formed on the same substrate as described in Example 1 by a wire bar coating process to a dry thickness of 10 μm to form a heat transferable sheet.

In the surface of the receptive layer obtained as described above, the periphery of ethylene-vinyl acetate resin which formed the first region was substantially surrounded by the polyvinyl alcohol resin which formed the second resin. The size of the second region formed by surrounding by the first region was in a range of no more than 5 μm. The proportion of the integrated surface area of the first region was 50% of the total.

When the heat transferable sheet obtained as described above and the same heat transfer printing sheet as described in Example 1 were used to carry out recording in the manner described in Example 1, the transfer printing layer of the heat transfer printing sheet was transferred to the surface of the resulting recorded sheet. When the transferred portions were removed by means of an adhesive tape, and thereafter the optical reflection density of the highly developed color density recording portions of the resulting recorded sheet was measured, a value of 1.0 was obtained.

When a thermal diffusion acceleration test was carried out by allowing the recorded sheet described above to stand for 7 days in a 60° C. oven, distortion of the image due to dye diffusion was not observed, and reduction of the density of the recording portions did not occur.

EXAMPLE 7

Synthetic paper (manufactured by Ohji Yuka, Japan under the name YUPO FPG-150) having a thickness of 150 μm was used as a substrate. A receptive layer-forming coating composition having the following composition was applied and formed thereon by a wire bar coating process to a dry thickness of 5 μm.

Receptive Layer-forming Coating Composition

| | |
|---|---|
| Elbaroi 742 (manufactured by Mitsui Polychemical, Japan) | 10 parts |
| KF-393 (amino-modified silicone oil manufactured by Sin-etsu Silicone, Japan; Tg = −32° C.) | 0.125 part |
| X-22-343 (epoxy-modified silicone oil manufactured by Sin-etsu Silicone, Japan) | 0.125 part |
| Toluene | 50 parts |
| Methyl ethyl ketone | 50 parts |

On the other hand, a mask for patterning the receptive layer formed as described above was prepared as follows.

First, a sheet of iron having a thickness of 0.1 mm was washed. A photosensitive resin (manufactured by Tokyo Ohka, Japan under the name FPR) was then applied onto the sheet by a spin coating process to a dry thickness of 5 μm. An original having a line width of 20 μm and a pitch of 200 μm was then superposed thereon and exposed to light in a printer provided with an ultra-high pressure mercury lamp (manufactured by Dojun Kohki, Japan) for one minute. Developing was carried out in a specific manner. The surface opposite to the patterning image was covered with a resin and thereafter etched with an iron chloride solution to obtain an iron mask having a reed screen-like pattern of a line width of 20 μm and a pitch of 200 μm.

This mask was then superposed on the receptive layer described above, and the masked layer was irradiated with electron rays under an accelerating voltage of 175 kV in a dose of 30 megarads by electron ray irradiation means to cure the receptive layer in the form of the pattern. Further, the mask described above was rotated through an angle of 90° on the receptive layer and thereafter similarly irradiated with electron rays in a dose of 30 megarads to partially crosslink the receptive layer in the form of lattice to obtain a heat transferable sheet. The portions partially crosslinked in the form of lattice correspond to the second region.

When the heat transferable sheet obtained as described above and the same heat transfer printing sheet as described in Example 1 were used to carry out recording in the manner described in Example 1, the optical reflection density of the highly developed color density recording portions of the resulting recorded sheet was found to be of a value of 1.8.

When the recorded sheet described above was allowed to stand for 7 days in a 60° C. oven to carry out a thermal diffusion acceleration test, distortion of the image due to dye diffusion was not observed, and reduction of the density of the recording portions did not occur.

EXAMPLE 8

A heat transfer printing sheet and a heat transferable sheet were obtained in the manner described in Example 1 except that 2.5 parts of Kayaset Red B manufactured by Nippon Kayaku (Japan) which was a Magenta dye was used in place of Kayaset Blue 136 manufactured by Nippon Kayaku (Japan), as a dye. These sheets were combined in the same manner as described in Example 1, and the relationship between time of application of voltage to the thermal head and the optical reflection density of the resulting highly developed color density recording portions was examined. The results obtained are indicated by curve 2 in FIG. 9.

EXAMPLE 9

A heat transfer printing sheet and a heat transferable sheet were obtained in the manner described in Example 1 except that 0.6 parts of PTY-52 manufactured by Mitsubishi Kasei (Japan) which was a yellow dye was used in place of Kayaset Blue 136 manufactured by Nippon Kayaku (Japan), as a dye. These sheets were combined in the same manner as described in Example 1, and the relationship between time of application of voltage to the thermal head and the optical reflection density of the resulting highly developed color density recording portions was examined. The results obtained are indicated by curve 3 in FIG. 9.

EXAMPLE 10

Printing was carried out in the manner described in Example 1 except that a condenser paper having a thickness of 10 μm was used in place of the PET film having a thickness of 9 μm as a support of a heat transfer printing sheet in Example 1, and the reverse side treatment with silicone oil was omitted. The optical reflection density of the highly developed color density recording portions of the recorded sheet exhibited a value of 1.40.

EXAMPLE 11

Printing was carried out in the manner described in Example 10 except that 2.5 parts of Kayaset Red B manufactured by Nippon Kayaku (Japan) was incorporated in place of Kayaset Blue 136 manufactured by Nippon Kayaku (Japan), as a dye in Example 10. The optical reflection density of the highly developed color density recording portions of the recorded sheet was 1.38.

EXAMPLE 12

Printing was carried out in the manner described in Example 11 except that 0.6 part of PTY-52 manufactured by Mitsubishi Kasei (Japan) was incorporated in place of Kayaset Blue 136 manufactured by Nippon Kayaku (Japan), as a dye in Example 10. The optical reflection density of the highly developed color density recording portions of the recorded sheet was 1.38.

COMPARATIVE EXAMPLE 3

Printing was carried out in the manner described in Example 1 except that synthetic paper the surface of which was covered with calcium carbonate powder (manufactured by Ohji Yuka, Japan under the name YUPO-FPG-150) was used as a heat transferable sheet. The optical reflection density of the highly developed color density recording portions of the recorded sheet was of a value as low as 0.44.

EXAMPLE 13

A primer layer-forming coating composition having the following composition was applied onto a polyethylene terephthalate film having a thickness of 100 μm (manufactured by Toray, Japan, under the name T-PET) by means of a rotary coater to a dry thickness of the layer of 1 μm. Drying was carried out by placing the PET film coated with the coating described above in a 90° C. oven for one minute.

Receptive Layer-forming Coating Composition

| | |
|---|---|
| AD502 (polyester polyol manufactured by Tokyo Motor, Japan) | 0.95 part |
| Collonate L (isocyanate manufactured by Nippon Polyurethan, K.K., Japan) | 0.05 part |
| Toluene | 6 parts |
| Methyl ethyl ketone | 6 parts |
| Ethyl acetate | 7 parts |

A negative-type photoresist (manufactured by Asahi Kasei, K. K., Japan under the name APR G-22) was then applied onto the surface of polyethylene terephthalate described above wherein the surface was provided with the primer layer by means of a rotary coater to a dry thickness of 50 μm. The primer layer was then dried in a 100° C. oven for 10 minutes.

The surface of the above negative-type resist layer was brought into contact with the surface of a silver salt permeable original film wherein it had a dot pattern comprising tetragonal patterns of sides of 170 μm each disposed at intervals of 30 μm. The laminated structure was exposed to light for 10 seconds, by means of a ultraviolet printer wherein a point source of high-pressure mercury lamp was used, and developed with a 0.2% sodium bicarbonate aqueous solution warmed to a temperature of 50° C. The uncured portions of the resist described above were dissolved and removed and washed to form a lattice-like pattern of a line width of 30 μm and an interval of 170 μm onto the film. This lattice-like pattern formed a second region. (Tg of this region is 80° C.).

A receptive layer-forming composition (I) having the following composition was then applied by means of a rotary coater and dried by means of a dryer. This step was repeated three times to form a first region at the portions surrounded by the lattice-like pattern on the film.

Receptive Layer-forming Composition (I)

| | |
|---|---|
| Elbaroi 741 (EVA polymer plasticizer manufactured by Mitsui Polychemical, Japan) | 10 parts |
| Toluene | 45 parts |
| Methyl ethyl ketone | 45 parts |

Further, a receptive layer-forming coating composition (II) described hereinafter was applied and formed by means of a rotary coater so that the portions of the film surrounded by the lattice-like pattern were thoroughly embedded on drying to form a heat transferable sheet. Drying was carried out for one hour at a temperature of 100° C. after temporarily drying by means of a dryer.

Receptive Layer-forming Composition (II)

| | |
|---|---|
| Elbaroi 741 (EVA polymer plasticizer manufactured by Mitsui Polychemical, K.K., Japan) | 10 parts |

-continued

| | |
|---|---|
| KF-393 (amino-modified silicone oil manufactured by Sin-etsu Silicone, K.K., Japan) | 0.125 part |
| X-22-343 (epoxy-modified silicone oil manufactured by Sin-etsu Silicone, K.K., Japan) | 0.125 part |
| Toluene | 45 parts |
| Methyl ethyl ketone | 45 parts |

In the surface of the receptive layer obtained as described above, the periphery of Elbaroi 741 which formed the first region was substantially surrounded by the negative-type photoresist which formed the second region. The side of the first region formed by surrounding by the photoresist was in a range of from 100 μm to 200 μm. The proportion of the integrated surface area of the first region was 70% of the total.

When the heat transferable sheet obtained as described above and the same heat transfer printing sheet as described in Example 1 were used to carry out recording in the manner described in Example 1, the optical reflection density of the highly developed color density recording portions of the resulting recorded sheet was 1.9.

When the recorded sheet described above was allowed to stand for 7 days in a 60° C. oven to carry out a thermal diffusion acceleration test, distortion of the image due to dye diffusion was not observed, and reduction of density of the recording portions did not occur.

EXAMPLE 14

Each component described hereinafter was amply kneaded by means of three rolls to form a receptive layer-forming coating composition having a viscosity of 2,500 ps.

Receptive Layer-forming Coating Composition

| | |
|---|---|
| Polyethylene glycol (molecular weight = 2,000) | 5 parts |
| Terpene phenol resin (manufactured by Yasuhara Yushi Kogyo, Japan under the name YS Polystar S-145) | 12 parts |
| Dioctyl phthalate | 2 parts |
| Triethyleneglycol-mono-n-butyl ether | 6 parts |
| Kaolin (manufactured by Tuchiya Kaolin, Japan under the name Kaolin ASP-170) | 14 parts |

A reproduction/press plate was formed on a waterless lithographic plate with a surface having a layer of silicon resin, by using a photographic original wherein a square pattern of sides each of 150 μm (black portion) was regularly disposed at intervals of 30 μm in both longitudinal and lateral directions. A mirror coated paper was printed with the receptive layer-forming coating composition described above to obtain a heat transferable sheet which comprised repeated island-like patterns 150 μm square.

When the thus obtained heat transferable sheet and the same heat transfer printing sheet as described in Example 1 were used to carry out printing in the manner described in Example 1, a developed color image having a maximum density of 1.4 was obtained. While this recorded sheet was heated for 7 days at a temperature of 50° C., the image did not fade because the developed color portions were thoroughly separated from one another.

The waterless lithographic printing plate used in the foregoing procedure was prepared as follows.

(1) Preparation of Silicone Resin 266 parts of acryloxypropyl trichlorosilane was dropwise added to a mixture of 500 parts of water, 100 parts of toluene and 50 parts of isopropanol over one hour at a temperature of from 5° to 10° C. The hydrochloric acid layer was then separated and the siloxane-toluene layer was washed with water until the pH was 6.8. To this siloxane-toluene layer were then added 612 parts of α,ω-dihydroxydimethyl organopolysiloxane having the formula

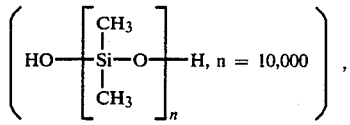

0.5 parts of potassium acetate, and 0.5 parts of hydroquinone.

The reaction was carried out for 8 hours at a temperature of from 110° to 115° C., and then the toluene was vacuum distilled. A pale yellow transparent solid organopolysiloxane having a pour point of 45° C. was obtained, and the yield thereof was 754 parts.

(2) Preparation of Sensitizer

A Grignard reagent was prepared in tetrahydrofuran from 0.2 mole of 4-trimethylsilylchlorobenzene and 0.2 mole of magnesium and reacted with 0.2 mole of 4-dimethylaminobenzaldehyde. Thereafter, 0.2 mole of benzaldehyde were added thereto to carry out an Oppenauer oxidation reaction, thereby synthesizing 4-dimethylamino-4'-trimethylsilylbenzophenone.

(3) Preparation of Lithographic Plate

| | |
|---|---|
| Photopolymerizable organopolysiloxane obtained in the step (1) | 100 parts |
| 4-Dimethylamino-4'-trimethylsilylbenzophenone obtained in the step (2) | 5 parts |
| Toluene | 1,000 parts |

The polymerizable formulation having the composition described above was rotationally applied onto an aluminum plate to obtain a film thickness of about 5 μm and dried to form a waterless lithographic plate.

(4) Preparation of Press Plate for Lithography

A photograph original was brought into contact with the non-aluminum surface of the waterless lithographic plate obtained in the step (3) under reduced pressure. The original and the plate was irradiated with light from a 3 kW high-pressure mercury lamp spaced 40 cm therefrom for 30 seconds, and thereafter developing was carried out with xylene. The plate was then wetted to obtain a press plate for lithography wherein water was unnecessary.

(5) Printing

The press plate obtained in the step (4) was used in an offset one-color press (KOR-type press manufactured by Heiderberger Druckmaschinen Aktiengesellschaft) to carry out printing. In printing a water rod was removed.

What is claimed is:

1. A sheet to be heat transfer printed which is to be used in combination with a heat transfer printing sheet, and which has a receptive layer for receiving a dye transferred from the heat transfer printing sheet upon being heated, said receptive layer comprising first and second regions characterized in that:

(a) the first region is formed from a synthetic resin having a glass transition temperature of from −100° to 20° C. and having a polar group;

(b) the second region is formed from a synthetic resin having a glass transition temperature of 40° C. or above;

(c) both the first region and the second region are exposed at the surface of the receptive layer, the first region occupying at least 15% of said surface; and (d) the first region exists in the form of mutually independent islands and the respective longitudinal length of the island-like portions is from 0.5 to 200 μm.

2. The sheet to be heat transfer printed according to claim 1 wherein said receptive layer is provided on the surface of a substrate.

3. The sheet to be heat transfer printed according to claim 1 wherein the first region-forming synthetic resin has a glass transition temperature of from −50° to 10° C.

4. The sheet to be heat transfer printed according to claim 1 wherein the first region-forming synthetic resin has a polar group selected from the group consisting of ester linkages, urethane linkages, amide linkages, urea linkages, C—CN linkages, and C—Cl linkages.

5. The sheet to be heat transfer printed according to claim 1 wherein the second region-forming synthetic resin has a glass transition temperature of from 50° to 150° C.

6. The sheet to be heat transfer printed according to claim 1 wherein the first region occupies from 15 to 95% of the surface of the receptive layer.

7. The sheet to be heat transfer printed according to claim 1 wherein the longitudinal lengths of the island-like portions of the first region are from 10 to 100 μm, and the periphery of the first region is substantially surrounded by the second region.

* * * * *